US012221271B2

(12) United States Patent
Heintz et al.

(10) Patent No.: US 12,221,271 B2
(45) Date of Patent: Feb. 11, 2025

(54) BEVERAGE CONTAINER FOR FORMING A HEAD ON A POURED BEVERAGE

(71) Applicant: Diageo Ireland Unlimited Company, Dublin (IE)

(72) Inventors: Amy Heintz, Columbus, OH (US); Jeff Boyce, Columbus, OH (US)

(73) Assignee: Diageo Ireland Unlimited Company, Dublin (IE)

( * ) Notice: Subject to any disclaimer, the term of this patent is extended or adjusted under 35 U.S.C. 154(b) by 413 days.

(21) Appl. No.: 17/779,000

(22) PCT Filed: Nov. 25, 2020

(86) PCT No.: PCT/EP2020/083423
§ 371 (c)(1),
(2) Date: May 23, 2022

(87) PCT Pub. No.: WO2021/105244
PCT Pub. Date: Jun. 3, 2021

(65) Prior Publication Data

US 2023/0032487 A1 Feb. 2, 2023

(30) Foreign Application Priority Data

Nov. 26, 2019 (GB) ..... 1917194

(51) Int. Cl.
*B65D 85/73* (2006.01)
*B65D 17/00* (2006.01)

(52) U.S. Cl.
CPC ..... *B65D 85/73* (2013.01); *B65D 17/02* (2013.01); *B65D 2205/02* (2013.01);
(Continued)

(58) Field of Classification Search
CPC ..... B65D 85/73; B65D 85/72; B65D 17/02; B65D 51/16; B65D 2205/02;
(Continued)

(56) References Cited

U.S. PATENT DOCUMENTS 4,494,681 A 1/1985 Ueda et al.
4,832,968 A 5/1989 Forage et al.
(Continued)

FOREIGN PATENT DOCUMENTS

GB 1286495 8/1972
GB 1513202 6/1978
(Continued)

*Primary Examiner* — Robert J Hicks
(74) *Attorney, Agent, or Firm* — Stephen T. Scherrer; Monique A. Morneault; Scherrer Patent & Trademark Law, P.C.

(57) ABSTRACT

A beverage container for a nitrogenated beverage comprises at least two restricted outlet apertures (11, 12) configured to, when pouring therefrom into a secondary vessel, form jets of beverage that impinge downstream. Impingement initiates nucleation of dissolved nitrogen gas in the beverage and, as such, when poured into the vessel a creamy head of fine nitrogen/mixed gas bubbles can be formed. The restricted outlet apertures can be formed in a plate (10) over an openable mouth of the beverage container, or directly upon the container. Preferably a vent (14) or some other feature is included to increase the velocity of the jets.

19 Claims, 1 Drawing Sheet

(52) U.S. Cl.
CPC ..... *B65D 2517/0014* (2013.01); *B65D 2517/0049* (2013.01); *B65D 2517/008* (2013.01); *B65D 2517/0091* (2013.01)

(58) Field of Classification Search
CPC ..... B65D 2205/00; B65D 2517/0014; B65D 2517/0049; B65D 2517/0047; B65D 2517/008; B65D 2517/0091
USPC .... 220/372, 371, 367.1, 730, 271, 270, 269, 220/266, 265, 906; 222/547
See application file for complete search history.

(56) References Cited

U.S. PATENT DOCUMENTS

| | | | | |
|---|---|---|---|---|
| 5,620,725 | A | 4/1997 | Jamieson et al. | |
| D804,947 | S * | 12/2017 | Straw | D9/447 |
| 2001/0032852 | A1* | 10/2001 | Naude | B65D 17/4012 220/269 |
| 2004/0178201 | A1* | 9/2004 | Cox | B65D 17/4012 220/730 |
| 2013/0126529 | A1 | 5/2013 | Nesling et al. | |
| 2014/0008367 | A1 | 1/2014 | Jung et al. | |
| 2016/0297578 | A1* | 10/2016 | Baker | B65D 17/4012 |
| 2018/0319581 | A1 | 11/2018 | Heintz et al. | |

FOREIGN PATENT DOCUMENTS

| | | |
|---|---|---|
| GB | 1532975 | 11/1978 |
| JP | S5674487 | 6/1981 |
| JP | 2009107722 | 5/2009 |
| WO | 8504086 | 9/1985 |
| WO | 2009008715 | 1/2009 |
| WO | 2013068594 | 11/2012 |
| WO | 2017076829 | 5/2017 |

* cited by examiner

| | |
|---|---|
| Highest peak | 5.23um |
| Lowest valley | 6.74 um |
| Maximum height | 12.0 um |
| Arithmetic mean roughness | 1.80 um |
| **Root mean square height** | **2.25 um** |

BEVERAGE CONTAINER FOR FORMING A HEAD ON A POURED BEVERAGE

TECHNICAL FIELD

The invention relates to a beverage container suitable for forming/managing the characteristics of a head on a beverage once poured from the container into a secondary vessel. The beverage container, or a structure associated with an openable end of such a container, is particularly suited in connection with dispensing a single serve of nitrogenated beer such as a stout.

BACKGROUND TO THE INVENTION

Nitrogenated beers are beers that are pressurized with a mixture of nitrogen and carbon dioxide. These products take advantage of the unique properties of nitrogen to create a range of desirable characteristics, including a less bitter taste and a creamy long-lasting head, which can be attributed to the smaller size of nitrogenated bubbles compared to those composed of $CO_2$ only.

However, this gas mixture exists in a metastable form in the beer at atmospheric pressure, and, therefore, dissolved gas does not tend to spontaneously foam the beer upon pouring. Instead a trigger is necessary to initiate nucleation and growth of bubbles. Under the appropriate trigger conditions, nucleation of the dissolved gas occurs during dispensing of the beer into the glass, yielding bubbles with the diameter in the range of 50 to 200 μm. The lower buoyancy of the small bubbles causes them to rise to the top of the glass more slowly than large bubbles, which is a desirable characteristic called, in the case of a stout beer, the "time to black"; i.e. the time required for all the bubbles to float to the top, ultimately leaving a light-coloured head and dark substantive volume of beverage below. A long time to black is desirable for aesthetic reasons. The entire effect of the rapid nucleation of gas bubbles and their slow rise to form the head is referred to in the art as "surge and settle".

Surge may be triggered using following methods:

(i) Flow Through an Orifice Plate

The most common delivery method for a nitrogenated beer in a public bar/restaurant environment is use of a special tap that forces the beer at high velocity, created by absolute pressure of approximately 3.77 bar (377 kPa), through an orifice plate with a number (e.g. five) small holes having diameter of 0.6 or 0.9 mm. The contraction of the fluid path, as it moves through the small orifices, accelerates the beer and the pressure drops as it passes through the holes. If the pressure drop is great enough, local pressure in the vicinity of the vena contracta (the location in the flow field with a minimum cross-sectional area) is less than the vapor pressure of the liquid. Under such conditions the liquid will vaporize and bubbles will nucleate. Although this approach is quite effective, it requires considerable velocities to observe the necessary pressure drop capable to promote the surge. For example, the tap system must drive fluid through the five holes at approximately 16 m/s. This solution is practical in a commercial establishment where investment in equipment is justified in view of the volume of beverage sold, but not so practical for lower volumes.

(ii) Jet Impingement by Widget

In the case of a single-serve package solution, canned or bottled nitrogenated beers may contain a widget. A widget is a plastic capsule, with a tiny hole connecting its interior to the surroundings, that floats on the surface of the beer. Upon pressurization during the filling process, the pressure equalizes in the widget, also forcing some beer into the widget as it does so. When the can or bottle is opened, the pressure in the headspace and beer rapidly drops toward atmospheric pressure. The contents of the widget then decompress by squirting gas and some beer into the surrounding beer. Jet impingement overcomes the barrier to nucleation by utilizing the kinetic energy from the high velocity jet as the gas exits the orifice in the widget; the gas jet is fragmented into discrete bubbles by the turbulent flow. In addition, the momentum of the flow is transferred to the liquid, inducing circulation and mixing throughout the liquid. Like the pressure requirements for the specialized tap used for draught beer, the functionality of the widget is provided by the pressure in the can, approximately 3.4 bar (340 kPa), which drives the fluid at high velocity through the device.

Although the aforementioned techniques for a head to be formed on a single serve of beer in a glass have been demonstrated to be effective and are commonly available: (i) orifice plates in combination with a requisite pressure source are considered impractical to package into a beverage container, and (ii) widgets are an added cost that slows down the canning/bottling line.

It is known in the beer community that "pouring hard" can initiate surge of a nitrogenated beer. "Pouring hard" is generally achieved by turning the can upside down into the glass. The chugging effect creates turbulence that tears the fluid and entrains air into the beer, which initiates a surge. However, this effect is not well-controlled and can result in undesirably large (>200 um) bubbles in the head. Such a head may be thin and break down quickly in a similar way to a fully carbonated beverage head.

Vented cans are known in the art. One example is described in US20130126529, which discloses a dual aperture opening that is opened by a single tab in two steps. First the vent is opened and then the can is opened. The vent allows the beer to flow at faster flow rates where flow rate can be adjusted by increasing the size of the vent.

U.S. Pat. No. 4,494,681 describes a dispenser designed to have the same effect as discharging beer under the pressure of carbon dioxide gas, particularly to form foam in a carbonated beverage. The dispenser, which may be incorporated with an aluminium can-style container end, forms a plurality of streams of beer during pouring. At least one of the streams should be small in order to encourage foam formation as it exits the dispenser, while a larger diameter stream pours beer in a generally unaffected state into a glass. There may be an air passage that lets air back into the container, to bubble through the beverage inside the can and replace the discharged beer. In particular examples, the streams from the dispenser are configured to be separated during pouring. Contact of the streams is perceived to ruin the effect of the smaller pouring port.

SUMMARY OF THE INVENTION

The invention seeks to provide a methodology and associated device or container construction that does not require any external equipment, to be effective at causing a surge in nitrogenated beer upon pouring.

In a broad aspect the invention provides a beverage container for nitrogenated beverage according to claim 1. In one form, the beverage container may include an openable mouth which, while pouring, directs beverage through at least two restricted apertures (which may be interchangeably termed: holes, openings, outlets, nozzles) for forming impinging jets and thereby causing nucleation of dissolved gas in the beverage over at least part of the pour time. A plurality of apertures spaced at a minimum distance apart (i.e. a minimum amount of material between edges of the apertures) are required in order to accomplish the inventive concept, namely a structure configured to establish formation of impinging jets of beverage at a minimum velocity, distance and associated force to achieve nucleation of dissolved nitrogen in the beverage as it is poured. In the context of the invention a "jet" of beverage is defined as a narrow stream with a velocity greater than 0.7 m/s. The jet velocity should be achieved over at least part of the pour time coincident with jet impingement, e.g. 15-40%, which is sufficient to initiate a surge that propagates throughout the beverage.

The beverage container includes a feature or means to increase the velocity of flowing beverage through the apertures and subsequent force of impinging jets. This means or feature could be a vent into the container or some other mechanism. For example, rapid deformation (i.e. crushing) of the package may provide the higher velocity needed for nucleation to take place in the beverage being forced through the restricted apertures. In the case of a vent, such an opening should be made at a location where it communicates with a headspace above the beverage, at least during pouring when the container will be tilted. Flow velocity is affected in practice by the pouring tilt angle. The tilt angle should begin relatively shallow and gradually increase in order to maintain a consistent flow rate as the head pressure/amount of beverage decreases. The tilt should be sufficient to generate a jet while not flooding any vent.

The disclosed invention overcomes the deficiencies of prior art systems to create a beverage container that enables surge and settle in nitrogen-containing beverages using only gravity assisted pouring. In an exemplary form, a beverage container according to the invention exhibits two main features/capabilities built into the can end; firstly a vent that is opened prior to pouring and, secondly, a modified opening (modified compared to a conventional pull-tab opening) that causes the beer to flow as two or more jetstreams which impinge, i.e. cross into, each other downstream of the opening. The modified opening may be integrated onto a can end by attaching a separate orifice plate over a conventional opening or through a novel end structure. In some embodiments, the orifice plate/end structure may be functionalized with a nucleation promoting surface such as explored in our patent publication WO2017/076829, i.e. a surface containing nano- and/or micro-scale structures that promote nucleation upon contact with the beverage.

The invention is also characterized by a method of configuring a beverage container and executing pouring to produce a desirable head. For example, the methodology of the invention requires providing a pouring structure that results in two or more impinging jet streams being formed where the subsequent force of the collision results in nucleation of dissolved nitrogen/mixed gas and formation of a creamy head in the poured beverage.

By way of further background it is noteworthy that, if a conventional orifice plate (such as used in a tap for draught beer delivery) is placed/sealed over the exit of a conventional can, two different outcomes are observed. Firstly, if the holes are too small (e.g. 3 holes of 1 mm diameter each), the flow is constrained; i.e. it may take greater than 30-60 seconds to drain a 440 mL can or beverage may not flow at all. Secondly, if the holes are larger (e.g. three holes of 5 mm diameter) flow can occur, but the orifice does not facilitate the surge initiation that is seen in a tap because the velocity is not high enough and/or there is no collision between streams. Using computational fluid dynamics (CFD) or hand calculations to estimate the beer velocity through the holes of such a scenario, the velocity is found to be less than 0.3 m/s.

Returning to the present invention, it was unexpectedly and surprisingly found that when an appropriate orifice plate or comparable structure with a limited number of restricted openings is/are placed over a can end, it is possible to achieve a surge that meets desirable requirements. A vent or some other means in combination with an orifice plate creates an impinging jet configuration at a velocity above approximately 0.7 m/s, to achieve desirable head characteristics in a poured single serve volume of nitrogenated beer. Indeed, the invention is at least partly considered to be recognition of the ability to implement an orifice plate or other format of restricted openings with a unit package such as an aluminium can, and the step of generating a sufficient flow velocity through the restricted openings, to collide jets formed by the opening, and achieve nucleation during at least part of the pour for delivering a creamy head. The prior art does not recognise this opportunity. It was thought that much higher velocities of beverage through an aperture (e.g. as in a conventional draught system) was necessary to achieve entrainment. The present inventors found that a desirable head could be achieved at lower velocity, although not so low as simply attaching a creamer plate across a conventional can opening.

DETAILED DESCRIPTION OF THE INVENTION

Figure 1:
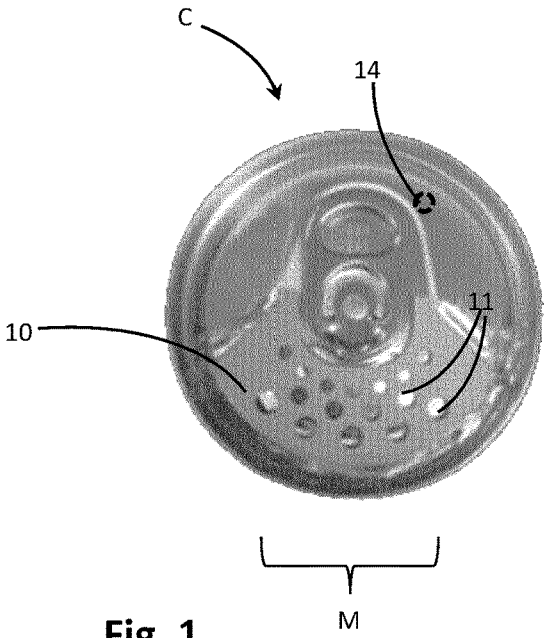
FIG. 1 illustrates a plan view of a first embodiment of can end, incorporating a structure according to the invention.
Figure 2:
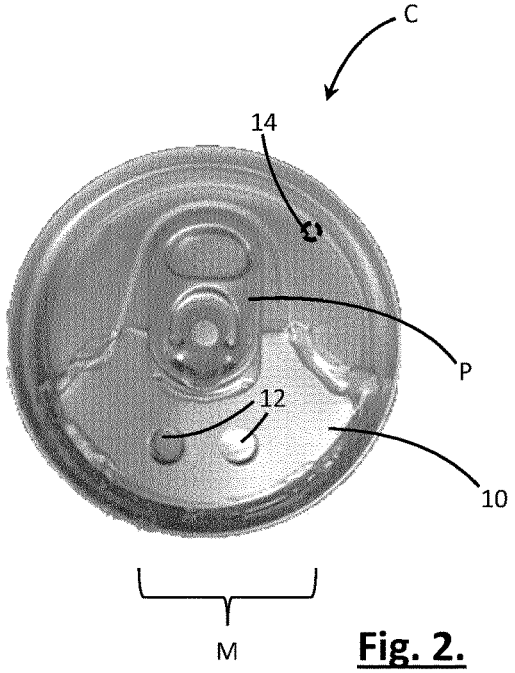
FIG. 2 illustrates a plan view of a second embodiment.

Examples of two effective orifice plates 10, as required to execute the inventive concept, incorporated across/over an openable mouth M of a beverage container visible from the can end C, are shown in FIGS. 1 and 2. The illustrated forms of end C also include a pull tab P that may be manually leveraged to open mouth M in a way familiar to a modern consumer. In use, pull tab P will tear open a flap into the beverage container, forming an open mouth M, and equalize the container contents with atmospheric pressure.

FIG. 1 features multiple apertures/holes 11 in a pattern through orifice plate 10, where the size of the holes gets progressively larger from 1.9 to 3.2 mm diameter and spaced apart by a similar dimension. By comparison FIG. 2 shows an orifice plate with a two-hole (denoted reference numeral 12) configuration, where the holes are approximately 5 mm diameter and spaced apart by a similar dimension to ensure a jet will form and not combine immediately into one stream. The illustrated examples of orifice plates 10 are approximately 1-2 mm thick and fitted by adhesives to the can end for demonstration purposes, however, such a structure could be welded or secured by other manufacturing methods. Alternative structures such as a block configuration with holes 11, 12 tunneled therethrough may be possible. The holes can also be configured as nozzles pointed to converge the streams of beverage passing through.

It was found that the illustrated configurations initiate surge when a vented can (e.g. where a vent may be formed in a non-visible side wall/base of container C or in the can end, to communicate with a head space above the beverage during pouring which may be at a tilt angle, indicated by dotted detail 14) is used. According to a preferred method of operation the vent 14 is opened first, thereby equalizing pressure into a headspace of the can C, then the tab P is pulled to open the standard tear panel of mouth M. Beer subsequently flows out of the multiple openings 11, 12 when the can is tilted/upended to face the opening of a secondary vessel such as a pint glass. Vent 14 in the illustrated form is spaced apart from the mouth M so as to communicate with a headspace in a tilted position and not become flooded during tilting. Vent 14 may be formed as part of the pull-tab process, or as a separate operation, e.g. a button-like arrangement where a spike is driven through the can end.

Using CFD to determine the velocity through the holes 11, 12 indicates that having a vent increases the velocity from approximately 0.3 m/s to greater than 0.7 m/s, depending on the restrictor holes' location.

Figure 3:
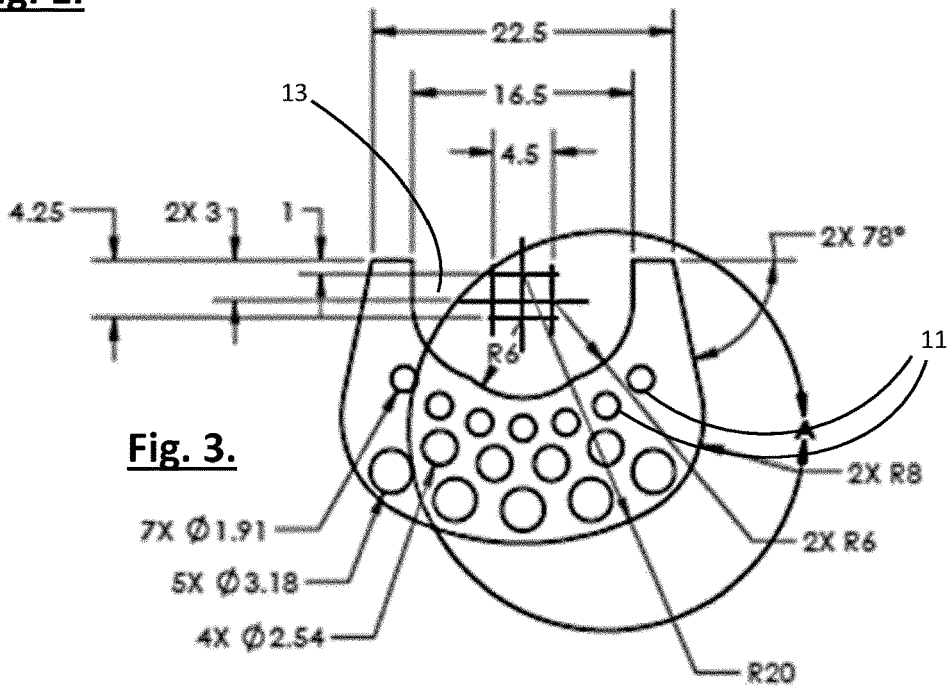
FIG. 3 illustrates a plan view of an orifice plate resembling the first embodiment; and, FIG. 4 illustrates an image of part of an anodized aluminum orifice plate generated by a scanning electron microscope.

FIG. 3 illustrates an embodiment of orifice plate 10 for attachment over the mouth opening M of a can end. It is a similar design to that of FIG. 1 where a cut-out shape 13 in the proximity of dimension R6 allows access to the standard tab function for opening a tear panel.

The likelihood of entraining gas bubbles increases with: increasing fluid velocity, decreasing jet length or increasing jet diameter, decreasing surface tension, and increasing viscosity or density. Generally, for low viscosity fluids like aqueous alcohol, velocity should exceed 1.5 m/s in a single stream hitting a surface for nucleation to occur. However, the present invention recognizes that jet impingement (i.e. colliding streams) reduces the required velocity for nucleation.

The orifices 11 of the orifice plate 10 would ordinarily function at a lower fluid velocity than required for entrainment as above. Therefore, the efficacy of the orifice plate of the invention is improved, not only as a consequence of the higher velocities that can be achieved with the vent, but also due to collision of multiple jets into each other. Such jets are therefore encouraged intentionally by the orifice plate configuration.

The size of the holes has minimal effect on the velocity, though due to drag at the inner surfaces, there is some minor effect. The velocity can be shown to reach a maximum near Reynold's number 100-1000. Furthermore, the thickness of the plate and the inner shaping of the orifices can play a role in routing the jets. The jets will collide during the pouring due to gravitational and surface tension effects. Alternatively, by properly choosing different sizes of holes, e.g. smaller at the top and larger at the bottom, the pouring arc of upper and lower jets can be changed so that they collide.

The vent size is an important consideration in maximizing the velocity. It is preferable that the vent is sized so that flow is not restricted. Generally, one finds that there is a maximum vent size, beyond which, no further improvements in flow rate are achieved. It is preferred to balance the number of holes and the vent size so that flow rate is approximately 20 to 50 mL/s; faster flow rates may be perceived as too rapid for consumers. Slower flow rates may lead to a consumer perception that the pouring opening is blocked in some way.

Efficacy, particularly smaller bubble size, can be further improved if a nucleation promoting surface is provided on the back-side (e.g. beer-facing side) and/or covering the orifice plate. Alternative configurations that feature a series of tunnels through an orifice block structure may include a nucleation promoting surface on walls of the orifices themselves. Appropriate surfaces include those with multi-scale structures (such as described in WO2017/076829), where sub-100 nm pits and sub-10-μm crevices are provided in a high surface energy material. Alternatively, high surface area coatings created by particles in coatings can also be considered.

EXPERIMENTAL RESULTS

In order to provide proof of the inventive concept, tests were carried out with Guinness® Draught "Surger" beer stored at 5° C. This beer is the same beverage product as found in kegs for draught applications on trade. It is supplied in a single serve aluminium can that does not contain a widget.

Under normal use conditions, if the canned beverage is poured carefully into the glass, i.e. by pouring the beer onto the side of the glass, the gas stays in the beer and the head height is observed as <5 mm tall (i.e. highly undesirable). However, when the beer is placed on a surger unit (i.e. ultrasound platform), the surge is initiated and a full head will evolve, which is 18-22 mm thick. One metric for measuring the efficacy of delivery is measuring the head height after surge and settle from a pour. A head height of 18-22 mm is a good result. The efficacy can be further measured by ensuring that there is no activity after placing on the ultrasonic surger unit.

Two other metrics known in the art are the depth of surge and the average bubble size. In a good test example, the colour of the beer will appear creamy-colored, not reddish-brown, all the way to the bottom or near to the bottom of the glass. This is the depth of surge. It is accompanied by a cascade of waves associated with surge as the beer transitions from bubbly flow to plug flow and the head forms. Finally, the average bubble size is determined by measuring the diameter of approximately 20 bubbles from the top to the bottom of the head. A good result has an average diameter less than 140 μm and preferably less than 120 μm.

Figure 4:
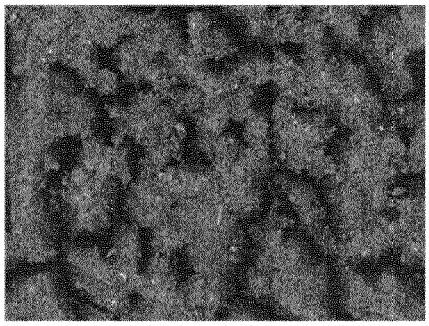

Orifice plates were made for trial purposes by creating a base plate from thin aluminum, polycarbonate, or polyvinyl chloride. In some embodiments, the aluminum was first etched by anodization with oxalic acid to create a 12-μm thick upper layer of rough porous, anodized aluminum having the morphology shown in FIG. 4. Scanning electron microscopy shows that the sample has nanoscale pitted features in the order of 50-75 nm. The image is 100 μm wide.

Holes were formed into the base plate, including: one hole, two holes, three holes, and multi-hole arrays. The size of the holes was varied, generally to ensure that the time to pour 440 mL of beer from a vented can was 12-30 seconds.

The base plate was glued to the service end of a Guinness® Draught Surger can and then placed into the refrigerator. Prior to testing, the can was opened and a vent was created with an awl. The vent diameter was generally 2 mm diameter. Then the beer was poured carefully into the glass, beginning at a shallow angle of tilt and gradually increasing same to manually maintain a consistent flow rate as far as possible.

Example 1: Two holes were punched into an aluminum plate as shown in FIG. 2. The diameter of these holes was 6.35 mm. The distance between the holes was varied. In one example, the distance between the center of the holes was 9.5 mm from center to center. When poured from a vented can two jets, along with a third coming from flow over the top, impinged (i.e. crossed together and intermingled). In another, the distance was 13 mm apart such that, when poured from a vented can, the jets remained separated for most of the flow.

TABLE

| 2 holes, 6.35 mm diameter Distance | Pour Time(s) | Average Flow rate (mL/s) | Head Height (mm) | Depth, Time to Black(s) | Average Bubble Size (μm) |
|---|---|---|---|---|---|
| 9.5 mm | 12 | 36.7 | 19 | Ok, 23 | 142 ± 24 |
| 13 mm | 12 | 36.7 | 14 | Ok, 18 | 170 ± 40 |

It is evident from Table 1 above that when the holes are arranged for jets to impinge, the gas is more effectively removed (resulting in greater head height).

Example 2: The same close configuration was used as in Example 1 (FIG. 2) above. The plates were made from either anodized Al, Al, or polycarbonate. In some samples the hole size was reduced to 5-mm diameter.

TABLE 2

| 2 holes | Pour Time(s) | Average Flow rate (mL/s) | Head Height (mm) | Depth, Time to Black(s) | Average Bubble Size (μm) |
|---|---|---|---|---|---|
| 6.35 mm ø, anodized | 15 | 29.3 | 18 | Good, 33 | 117 ± 21 |
| 6.35 mm, AI | 15 | 29.3 | 18 | Ok, 23 | 145 ± 19 |
| 6.35 mm, PC | 13 | 33.8 | 19 | Ok, 25 | 157 ± 28 |
| 5 mm, anodized | 15 | 29.3 | 19 | Good, 33 | 114 ± 24 |
| 5 mm, AI | 17 | 25.9 | 19 | Ok, 25 | 137 ± 22 |
| 5 mm, PC | 15 | 29.3 | 18 | Good, 29 | 123 ± 20 |

From Table 2 above it is evident that the results were optimised with the anodized sample, as this material is known to promote nucleation of the beer. The multi-scale structure holds sub-critical nuclei (e.g. very small air pockets) that are released as a bolus of small bubbles during the pour, promoting smaller bubble sizes.

Reducing the orifice diameter provided a slightly better result. This may be because, if the volumetric flow rate is equal, the velocity will be higher for the fluid passing through the smaller diameter holes.

Example 3. A multi-hole configuration as shown in FIG. 1 was formed into an aluminum or anodized aluminum plate. The holes were prepared with increasing size to control the flow pattern so that the fluid impinged and mixed with each other.

TABLE 3

| Multi-hole | Pour Time(s) | Average Flow rate (mL/s) | Head Height (mm) | Depth, Time to Black(s) | Average Bubble Size (μm) |
|---|---|---|---|---|---|
| Anodized | 15 | 29.3 | 18 | Good, 24 s | 121 |
| AI | 20 | 22 | 18 | Ok, 18 s | 135 |

It is evident from Table 3 above that a multiple hole sample is comparable to the two-hole version, although slightly improved with the anodized material. A multi-hole configuration is thought preferable in practice over a two-hole configuration since a less precise pour is needed by the consumer. If the can is angularly offset in a consumer's hand during pouring it may cause jets to move out of impingement in the two-hole pour configuration.

The inventive concept, once identified, can be implemented with available materials and production techniques. A can end may be redesigned or modified to include a separately openable mouth, orifice and/or vent features in a convenient package. Alternatively, a separate and reusable insert device/end cap could be applied to a conventional can end before or after the mouth is opened. A hollow needle/spike on one side/portion of the insert may puncture into a headspace volume of the container and provide a venting function while a main flow of beverage is, during pouring, directed through restricted openings in another side/portion. The restricted openings are placed so as to cause a crossing of streams to improve nucleation in the beer. Flow velocity is affected in practice by the pouring tilt angle. The tilt angle should begin relatively shallow and gradually increase in order to maintain a consistent flow rate as the head pressure/amount of beverage decreases. The tilt should be sufficient to generate a jet while not flooding any vent.

In alternative forms increased velocity may be realized by developing a squeeze pressure on a pouch-like beverage container or headspace; for example, intentionally deforming/crushing the container walls to reduce volume and force beverage at a faster rate through an orifice plate. A plunger or other external pressure source may also serve to increase velocity.

An openable mouth according to the examples illustrated herein appears as a separate feature from the orifice plate. However, it is apparent that a conventional mouth opening is not necessarily essential and, instead, a permanent orifice plate equivalent structure may be formed into a can end with restrictor holes openable for use. Such holes may be plugged during transport and unplugged for use.

Alternatively, a plate with a series of puncturing means on one side may be supplied for application to a blank-faced can end that drives both orifice/jet holes and a vent hole simultaneously into the face of the end by application of manual pressure to the other side of the plate.

The invention claimed is:

1. A single-serve beverage container of nitrogenated beverage, the container comprising an end having at least two jet-forming outlet apertures and a vent or other feature to increase beverage velocity through the at least two jet-forming outlet apertures, the container being configured to, when pouring therefrom, form jets of beverage that impinge downstream for initiating nucleation of dissolved gas in the beverage.

2. The beverage container of claim 1, comprising a vent openable into the headspace of the container.

3. The beverage container of claim 2, wherein the number and area of outlet apertures in combination with the area of the vent is selected to achieve a flow rate of 20-50 mL/s.

4. The beverage container of claim 1, comprising a nucleation promoting surface located to be contactable with the nitrogenated beverage while pouring.

5. The beverage container of claim 1, comprising an openable mouth located between an internal volume of the container and a structure in which is formed the at least two outlet apertures.

6. The beverage container of claim 1, wherein the at least two outlet apertures are openable for use.

7. The beverage container of claim 6, wherein the at least two outlet apertures are plugged prior to use and unpluggable for use.

8. The beverage container of claim 1, wherein the other feature to increase beverage velocity is a deformable wall.

9. The beverage container of claim 1, wherein the at least two outlet apertures are formed in a material comprised of aluminium, anodized Al, PVC or polycarbonate.

10. The beverage container of claim 9, wherein the material is anodized aluminium.

11. The beverage container of claim 1, wherein the at least two outlet apertures are each between 2 to 10 mm in diameter.

12. The beverage container of claim 1, wherein next adjacent apertures of the at least two outlet apertures are spaced between 8 and 15 mm apart center-to-center.

13. The beverage container of claim 1, wherein there are more than two different diameters of outlet aperture.

14. The beverage container of claim 13, wherein the outlet apertures are arranged in a pattern radiating from a central longitudinal axis of the container and wherein apertures generally increase in diameter the further they are located from the axis.

15. The beverage container of claim 1, wherein the at least two outlet apertures are configured to achieve a flow therethrough having a Reynold's number of 100 to 1000.

16. A device configuring a beverage container to function according to claim 1, the device comprising the at least two outlet apertures formed through a surface of the device, said apertures alignable with an openable mouth of the container.

17. The device according to claim 16, comprising at least one puncturing element for puncturing through a wall of the beverage container.

18. A method of pouring a nitrogenated beverage from a single-serve beverage container to form a creamy head on the beverage in a secondary vessel, wherein the container includes at least two jet-forming outlets therefrom, the method including the steps of:

opening the beverage container so that flow of beverage through the at least two outlets is possible;

tilting the beverage container over an opening of the secondary vessel so as to pour beverage through the at least two apertures and form at least two corresponding jets that converge downstream of the outlets and initiate nucleation of dissolved gas, toward the secondary vessel;

wherein a velocity of the jets sufficient to initiate nucleation is achieved by a vent opened through a wall of the beverage container and/or causing deformation of a wall of the container.

19. The method of claim 18, wherein flow of beverage exhibits a Reynold's number of 100 to 1000.

* * * * *